United States Patent [19]

Endres et al.

[11] 3,973,904

[45] Aug. 10, 1976

[54] WATER-SOLUBLE SYNTHETIC TANNING AGENTS

[75] Inventors: Horst Endres; Otto Hertel; Franz-Friedrich Miller, all of Ludwigshafen, Germany

[73] Assignee: Badische Anilin- & Soda-Fabrik Aktiengesellschaft, Ludwigshafen (Rhine), Germany

[22] Filed: Mar. 10, 1972

[21] Appl. No.: 233,755

[30] Foreign Application Priority Data

Mar. 18, 1971 Germany ..... 2113096

[52] U.S. Cl. ..... 8/94.24

[51] Int. Cl.[2] ..... C14C 3/18

[58] Field of Search ..... 8/94.19 R, 94.24, 94.33; 252/8, 57

[56] References Cited

UNITED STATES PATENTS

| | | | |
|---|---|---|---|
| 2,829,122 | 4/1958 | Schuttheis et al. | 260/49 |
| 3,423,452 | 1/1969 | Lipowski | 260/512 R |
| 3,477,801 | 11/1969 | Lipowski | 8/94.33 |
| 3,512,918 | 5/1970 | Endres et al. | 8/94.24 |
| 3,617,186 | 11/1971 | Windus et al. | 8/94.24 |

FOREIGN PATENTS OR APPLICATIONS

| | | | |
|---|---|---|---|
| 870,503 | 5/1971 | Canada | 8/94.24 |
| 1,178,081 | 9/1964 | Germany | 8/94.24 |
| 1,935,006 | 1/1971 | Germany | 8/94.24 |
| 1,142,173 | 1/1963 | Germany | 8/94.24 |

OTHER PUBLICATIONS

"Tanning Materials" (13) pp. 593–599, R.L. Stubbings Kirk–Othmer *Encyclopedia of Chemical Technology* (1955).

*Primary Examiner*—Marion E. McCamish
*Assistant Examiner*—William R. Dixon, Jr.
*Attorney, Agent, or Firm*—Johnston, Keil, Thompson & Shurtleff

[57] ABSTRACT

Water-soluble synthetic tanning agents composed of formaldehyde condensation products of non-sulfonated aromatic hydroxy compounds or the sulfomethylation products thereof with aromatic sulfonic acids or with the formaldehyde condensation products of said sulfonic acids.

4 Claims, No Drawings

WATER-SOLUBLE SYNTHETIC TANNING AGENTS

This invention relates to synthetic hydroxyaromatic tanning agents in admixture with compounds containing sulfonic acid groups.

In order to obtain tanning agents which have sufficient tanning activity, it is common practice to effect their manufacture by condensing reactive hydroxyaromatic components with other reactive low molecular weight compounds. The synthetic tanning agents most commonly used are condensation products of phenols, naphthalene, naphthol and derivatives thereof, with aldehydes, preferably formaldehyde. Since tanning is usually carried out in aqueous solution, these relatively water-insoluble condensation products must be rendered water-soluble. Tanning agents composed of polyhydric phenols, such as resorcinol, usually possess the required solubility of water without it being necessary to introduce additional hydrophilic groups. In the case of condensation products based on phenol or naphthol or derivatives thereof, however, it is necessary to introduce hydrophilic groups, particularly sulfonic acid groups, in order to impart the necessary water-solubility to the condensation product. To this end, the condensation products are sulfonated, for example with concentrated sulfuric acid. An alternative method, for example, is to condense sulfonated phenols or naphthols and phenols or naphthols which are free from sulfonic acid groups with aldehydes, such as formaldehydes.

The introduction of sulfonic acid groups into the condensation products has a strong influence on the tanning properties. As the number of sulfonic acid groups in the molecule increases, the water-solubility and dispersibility improve but the tanning power is substantially reduced. Thus attempts have been made for many years to manufacture synthetic tanning agents which are free from sulfonic acid groups. Hitherto, such attempts have only been successful in the case of resorcinol/formaldehyde condensation products. Such condensation products are soluble in water without the inclusion of sulfonic acid groups, but, apart from their high cost, they suffer from the serious disadvantage that they are very sensitive to light, which means that it is not possible to produce light-colored leathers using such tanning agents.

It has also been proposed to effect tanning using methylol derivatives of mono- or dinuclear hydroxyaromatic compounds under weakly acid to weakly alkaline conditions, since the methylol compounds used as tanning agents are insoluble under the acid conditions normally used during tanning.

It is thus an object of the invention to provide tanning agents which are insensitive to light, are water-soluble and show satisfactory activity in all kinds of tanning operations. It is a further object of the invention to provide sulfonic acid group-containing tanning agents or tanning compositions which show optimum tanning activity and minimum light sensitivity but are nevertheless easy to produce.

According to the invention there are provided compositions comprising:

a. from 25 to 75% by weight — with reference to the weight of (a) + (b) — of condensation products based on formaldehyde and mono-or dinuclear hydroxy compounds which are free from aromatically bonded sulfonic acid groups, or sulfomethylation products thereof, or mixtures thereof and b. from 75 to 25% by weight of aromatic or hydroxyaromatic sulfonic acids or mixtures thereof and their condensation products with formaldehyde or their condensation products with formaldehyde and urea, or mixtures of such condensation products, at least a portion of said sulfonic acids being present in the form of alkali metal and/or ammonium salts.

It has been found that these compositions constitute water-soluble tanning agents of excellent activity, which give leathers with a high degree of whiteness and fine pores and which above all impart a hitherto unobtainable light fastness to the leather.

Suitable mono- or dinuclear aromatic hydroxy compounds (*a*) are for example phenol, naphthol, resorcinol, pyrocatechol, dioxydiphenylpropane, dihydroxydiphenylsulfone and/or their sulfomethylation products, halophenols, such as chlorophenol or bromophenol, and xylenols.

Examples of suitable sulfonic acids (*b*) are, in addition to benzenesulfonic acid and the naphthalenesulfonic acids, phenolsulfonic acid and β-naphtholsulfonic acids and their formaldehyde condensation products and their formaldehyde/urea condensation products.

Preferred components (a) are the sulfomethylation products obtained by reacting the phenols with formaldehyde and bisulfite. Specific examples of preferred components are the mononuclear phenols, which include for example phenol and chlorinated or brominated phenol, and the dinuclear dihydroxy compounds, of which the nuclei are not fused together. Specifically, components of particular commercial interest are phenol itself and dioxydiphenylpropane and dioxydiphenylsulfone.

Particularly suitable components (b) are the condensation products or aromatic sulfonic acids with urea and formaldehyde. Tanning agents containing these products as component (b) show surprisingly high tanning activity and leathers tanned therewith have excellent light fastness and also a distinctly higher degree of whiteness. Moreover, these leathers show distinctly finer pores for a given degree of fullness and softness and a given handle.

Thus the high tanning activity of condensation products free from sulfonic acid groups is fully retained in the tanning agents of the present invention, and it is found that the tanning activity actually increases in the presence of condensation products of aromatic sulfonic acids and formaldehyde and urea.

The ratio of component (a) to component (b) may vary within the limits stated. Using the tanning agents of the invention it is possible to obtain fine graduations in the tanning effects, since the composition of the tanning agents may be easily altered to suit different purposes by varying the proportions of (a) and (b). The present tanning agents may also be used in conjuntion with known tanning agents provided the latter are suitable for the usual tanning processes.

A tanning agent giving a full and soft tan contains from 75 to 25% by weight, based on (a) + (b), of components (b). On the other hand, if it is desired to produce a tanning agent having good dispersibility, it is advantageous to keep the content of component (b) high, i.e., at from 50 to 75% by weight based on (a) + (b). This is desirable, for example, when vegetable tanning agents are used in conjunction with the tanning agents of the invention.

Tanning agents of the present invention are advantageously prepared by mixing a solution obtained by condensing formaldehyde with the said aromatic hydroxy compound (a) or a solution of the sulfomethylation product obtained after reaction with sodium hydrogen sulfite, with a solution of the said aromatic sulfonic acid (b) at room temperatures of up to 25°C and adjusting the pH to the desired level. This mixture is ready for use once the pH has been adjusted to from 3.2 to 3.8, and it may be directly used for tanning or it may be dried to a powder by spray drying. The fact that the components (a) and (b) require only simple stirring together simplifies and cheapens the manufacture of these synthetic tanning agents based on hydroxyaromatic compounds and formaldehyde. Furthermore, unlike other manufacturing processes, it is not possible for overcondensation, which reduces the tanning activity, to occur.

Our new tanning agents are compositions which may be varied to meet different tanning requirements in an optimum manner.

The invention is further illustrated but not limited by the following Examples, in which parts and percentages are by weight.

EXAMPLE 1 a. 256 parts of naphthalene and
268 parts of 96–98% sulfuric acid are allowed to sulfonate for 4 hours at 150°–155°C. The sulfonic acid is allowed to cool to about 100°C and is then diluted with
116 parts of water. There are then added
60 parts of commercial urea.
200 parts of 30% formaldehyde are then added at 80°C over 10 minutes. The mixture is heated to 100°C and stirred at this temperature until the smell of formaldehyde has disappeared (after about 10 hours).

b. Sulfomethylation of 4,4′-dioxydiphenylpropane
456 parts of 4,4′-dioxydiphenylpropane,
40 parts of 50% caustic soda solution and
300 parts of 30% formaldehyde are dissolved at from 70°–80°C and the solution is allowed to cool to about 50°C. There are then added
104 parts of sodium bisulfite and the mixture is held at 80°C for 4 hours and then allowed to cool. The two condensates (a) and (b) are mixed and adjusted to pH 3.3–3.6 with
90 parts of 25% ammonia. The resulting solution is dried in a laboratory spray dryer having an inlet temperature of 220°–230°C and an outlet temperature of 100°–110°C.

There is obtained a yellowish powder (1,100 parts) which gives a clear solution in water having a pH of 3.5.

| Analysis results | |
|---|---|
| Tans | 78.3% |
| Nontans | 19.6% |
| % of tans in total solubles | 80.0 |

EXAMPLE 2

The naphthalenesulfonic acid/formaldehyde/urea condensation product prepared in Example 1 is used as (a).

b. 500 parts of 4,4′-dioxydiphenylsulfone,
230 parts of sodium sulfite powder,
328 parts of 30% formaldehyde and
940 parts of water are stirred together for 12 hours in an autoclave at from 148°–153°C, cooled and diluted with water to a weight of 2,000 parts. The two condensation products (a) and (b) are mixed, the pH of the resulting solution being 3.8. The solution is dried in a laboratory spray dryer having an inlet temperature of 220°–230°C and an outlet temperature of 100°–110°C.

There are obtained 1,230 parts of a pale yellow powder which gives a clear solution in water having a pH of 3.8.

| Analysis results | |
|---|---|
| Tans | 74.4% |
| Nontans | 24.2% |
| % of tans in total non-solubles | 75.2 |

EXAMPLE 3 a. 260 parts of naphthalene and
268 parts of 96–98% sulfuric acid are allowed to sulfonate at 150°–155°C for 4 hours. The sulfonic acid is allowed to cool to about 100°C and is diluted with
116 parts of water. There are then added
60 parts of dimethylol urea, and
100 parts of 30% formaldehyde are added over 10 minutes at 80°C. The mixture is heated to 100°C and stirred at that temperature until the smell of formaldehyde has disappeared (after about 10 hours). The condensate is then diluted with
50 parts of water.

b. Sulfomethylation of 4,4′-dioxydiphenylpropane
456 parts of 4,4′-dioxydiphenylpropane,
40 parts of 50% caustic soda solution and
300 parts of 30% formaldehyde are dissolved at 70°–80°C and cooled to about 50°C. There are then added
104 parts of sodium bisulfite. The mixture is held at 80°C for 4 hours and then cooled. The condensates (a) and (b) are mixed and adjusted to pH 3.3–3.6 with about
170 parts of 25% aqueous ammonia.
The mixture is dried with a laboratory spray dryer having an inlet temperature of 220°–230°C and an outlet temperature of 100°–110°C.

There are obtained 1,100 parts of a pale yellow powder which gives a clear solution in water having a pH of 3.4.

| Analysis results | |
|---|---|
| Tans | 80.3% |
| Nontans | 17.8% |
| % of tans in total solubles | 81.9% |

EXAMPLE 4 a. Naphthalenesulfonic acid/dimethylolurea condensation product prepared in Example 3.

b. 500 parts of 4,4′-dioxydiphenylsulfone,
230 parts of sodium sulfite,
328 parts of 30% formaldehyde and 940 parts of water are stirred together in an autoclave for 12 hours at 148°–153°C, cooled and made up with water to a weight of 2,000 parts.

The condensation products (a) and (b) are mixed to give a solution having a pH of 3.8.

The solution is dried with a laboratory spray dryer having an inlet temperature of 220°–230°C and an outlet temperature of 100°–110°C.

There are obtained 1,230 parts of a pale yellow powder giving a clear solution in water having a pH of 3.8.

| Analysis results | |
|---|---|
| Tans | 74.4% |
| Nontans | 24.3% |
| % of tans in total solubles | 75.2. |

EXAMPLE 5 a. 288 parts of β-naphthol and
324 parts of 96–98% sulfuric acid are allowed to sulfonate at 115°C for 2 hours. The sulfonic acid is allowed to cool a little and is then diluted with
100 parts of water.
60 parts of urea are added and
200 parts of 30% formaldehyde are added at 80°C and the mixture is heated to about 100°C and stirred at that temperature until the smell of formaldehyde disappears (after about 10 hours).

b. Sulfomethylation of phenol
188 parts of phenol,
7 parts of 50% caustic soda solution and
200 parts of 30% formaldehyde are stirred together for 1 hour at 55°–60°C and 4 hours at 80°C. The mixture is allowed to cool a little, and
66 parts of sodium bisulfite are added, and the mixture is stirred for 4 hours at 80°C and cooled.

The condensates (a) and (b) are mixed and adjusted to pH 3.3–3.6 with
90 parts of 25% ammonia.

The solution is dried with a laboratory spray dryer having an inlet temperature of 220°–230°C and an outlet temperature of 100°–110°C. There are thus obtained 800 parts of a light gray powder giving a clear solution in water having a pH of 3.5.

| Analysis results | |
|---|---|
| Tans | 75.2% |
| Nontans | 19.7% |
| % of tans in total solubles | 78.0. |

EXAMPLE 6 a. 288 parts of β-naphthol and
324 parts of 96–98% sulfuric acid are allowed to sulfonate at 115°C for 2 hours. After cooling, the sulfonic acid is diluted with
100 parts of water.
60 parts of urea are added and
200 parts of 30% formaldehyde are added at 80°C. The mixture is heated to 100°C and stirred at that temperature until the smell of formaldehyde has disappeared (after about 10 hours).

b. Sulfomethylation of 4,4′-dioxydiphenylpropane
456 parts of 4,4′-dioxydiphenylpropane,
40 parts of 50% caustic soda solution and
300 parts of 30% formaldehyde are dissolved at 70°–80°C. The solution is cooled to about 50°C, and
104 parts of sodium bisulfite are added. The mixture is stirred at 80°C for 4 hours and cooled. The condensates (a) and (b) are mixed and adjusted to pH 3.3–3.6 with
90 parts of 25% ammonia solution.

The solution is dried in a laboratory spray dryer having an inlet temperature of 220°–230°C and an outlet temperature of 100°–110°C. There are obtained 1,100 parts of a light gray powder which gives a clear solution in water having a pH of 3.5.

| Analysis results | |
|---|---|
| Tans | 79.5% |
| Nontans | 18.1% |
| % of tans in total solubles | 82.0. |

EXAMPLE 7 a. 210 parts of naphthalene and
214 parts of 96–98% sulfuric acid are allowed to sulfonate at 150°–155°C for 4 hours. The sulfonic acid is allowed to cool to about 100°C and is then diluted with
93 parts of water.
48 parts of urea (commercial grade) are added and
160 parts of 30% formaldehyde are added over 10 minutes at 80°C.

The mixture is heated to 100°C and stirred at that temperature until the smell of formaldehyde has disappeared (after about 10 hours).

b. Sulfomethylation of 4,4′-dioxydiphenylpropane
546 parts of 4,4′-dioxydiphenylpropane,
47 parts of 50% casutic soda solution and
370 parts of 30% formaldehyde are dissolved at 70°–80°C and the solution is cooled to about 50°C. There are then added
125 parts of sodium bisulfite, and the mixture is held at 80°C for 4 hours and cooled.

The condensates (a) and (b) are mixed and adjusted to pH 3.3–3.6 with
90 parts of 25% ammonia.

The resulting solution is dried in a laboratory spray dryer having an inlet temperature of 220°–230°C and an outlet temperature of 100°–110°C.

There are obtained 1,100 parts of a yellowish powder giving a clear solution in water, the said solution having a pH of 3.6.

| Analysis results | |
|---|---|
| Tans | 76.5% |
| Nontans | 20.8% |
| % of tans in total solubles | 78.6. |

EXAMPLE 8 a. 154 parts of naphthalene and
161 parts of 96–98% sulfuric acid are allowed to sulfonate for 4 hours at 150°–155°C. The sulfonic acid is allowed to cool to about 100°C and is then diluted with
70 parts of water.
36 parts of commercial grade urea are added and 120 parts of 30% formaldehyde are added over 10 minutes at 80°C.

The mixture is heated to 100°C and stirred at that temperature until the smell of formaldehyde has disappeared (after about 10 hours).

b. Sulfomethylation of 4,4'-dioxydiphenylpropane,
638 parts of 4,4'-dioxydiphenylpropane,
56 parts of 50% caustic soda solution and
420 parts of 30% formaldehyde are dissolved at 70°–80°C and the solution is cooled to about 50°C. There are then added
146 parts of sodium bisulfite. The temperature is maintained at 80°C for 4 hours and then cooled. The condensates (a) and (b) are mixed and adjusted to pH 3.3–3.6 with
60 parts of 25% ammonia.

The resulting solution is dried with a laboratory spray dryer having an inlet temperature of 220°–230°C and an outlet temperature of 100°–110°C. There are obtained 1,100 parts of a yellowish powder which gives a clear solution in water having a pH of 3.6.

| Analysis results | |
|---|---|
| Tans | 67.0% |
| Nontans | 30.0% |
| % of tans in total solubles | 69.1. |

EXAMPLE 9 a. 307 parts of naphthalene and
322 parts of 96–98% sulfuric acid are allowed to sulfonate for 4 hours at 150°–155°C. The sulfonic acid is allowed to cool to about 100°C and then diluted with
139 parts of water, to which there are added
72 parts of commercial grade urea followed, at 80°C, by
240 parts of 30% formaldehyde over 10 minutes. The mixture is heated to 100°C and stirred at that temperature until the smell of formaldehyde has disappeared (after 10 hours).

b. Sulfomethylation of 4,4'-dioxydiphenylpropane
365 parts of 4,4'-dioxydiphenylpropane,
32 parts of 50% caustic soda solution and
240 parts of 30% formaldehyde are dissolved at 70°–80°C and the solution is cooled to about 50°C. There are then added
83 parts of sodium bisulfite; the temperature is kept at 80°C for 4 hours, after which the solution is allowed to cool. The condensates (a) and (b) are mixed and adjusted to pH 3.3–3.6 with
159 parts of 25% ammonia.

The resulting solution is dried in a laboratory spray dryer having an inlet temperature of 220°–230°C and an outlet temperature of 100°–110°C.

There are obtained 1,100 parts of a yellow powder which gives a clear solution in water having a pH of 3.6.

| Analysis results | |
|---|---|
| Tans | 80.1% |
| Nontans | 17.4% |
| % of tans in total solubles | 82.1. |

EXAMPLE 10 a. 358 parts of naphthalene and
375 parts of 96–98% sulfuric acid are allowed to sulfonate for 4 hours at 150°–155°C. The sulfonic acid is then allowed to cool to about 100°C and is diluted with
162 parts of water. There are then added
84 parts of commercial urea followed, at 80°C over 10 minutes, by
280 parts of 30% folmaldehyde. The mixture is heated to 100°C and stirred at that temperature until the smell of formaldehyde has disappeared (after about 10 hours).

b. Sulfomethylation of 4,4'-dioxydiphenylpropane
273 parts of 4,4'-dioxydiphenylpropane
24 parts of 50% caustic soda solution and
180 parts of 30% folmaldehyde are dissolved at 70°–80°C. The solution is cooled to about 50°C. There are then added
62 parts of sodium bisulfite. The temperature of the mixture is held at 80°C for 4 hours before the mixture is cooled. The condensates (a) and (b) are mixed and adjusted to pH 3.3–3.6 with
178 parts of 25% ammonia solution. The resulting solution is dried in a laboratory spray dryer having an inlet temperature of 220°–230°C and an outlet temperature of 100°–110°C. There are obtained 1,100 parts of a yellow powder which gives a clear solution (pH 3.6) in water.

| Analysis results | |
|---|---|
| Tans | 75.9% |
| Nontans | 21.6% |
| % of tans in total solubles | 77.9. |

EXAMPLE 11 a. 228 parts of β-naphthol and
324 parts of 96–98% sulfuric acid are allowed to sulfonate for 4 hours at 150°–155°C. The sulfonic acid is allowed to cool to about 100°C and diluted with
100 parts of water. There are then added
60 parts of dimethylolurea, followed, at 80°C over 10 minutes, by
200 parts of 30% formaldehyde. The mixture is heated to 100°C and maintained at that temperature with stirring until the smell of formaldehyde has disappeared (after about 10 hours).

b. Sulfomethylation of 4,4'-dioxydiphenylpropane
456 parts of 4,4'-dioxydiphenylpropane,
40 parts of 50% caustic soda solution and
300 parts of 30% formaldehyde are dissolved at 70°–80°C and the solution is cooled to about 100°C. There are then added
104 parts of sodium bisulfite. The mixture is heated at 80°C for 4 hours and then allowed to cool. The condensates (a) and (b) are mixed and adjusted to pH 3.6–3.8 with
90 parts of 25% ammonia.

The resulting solution is dried in a laboratory spray dryer having an inlet temperature of 220°–230°C and an outlet temperature of 100°–110°C.

There are thus obtained 1,100 parts of a bright gray powder giving a clear solution (pH 3.6) in water.

| Analysis results | |
|---|---|
| Tans | 80.5% |
| Nontans | 19.7% |
| % of tans in total solubles | 81.1. |

We claim:

1. Synthetic water-soluble tanning agents substantially comprising a mixture of:

a. from 25 to 75% by weight — with reference to the weight of (a) + (b) — of condensation products based on formaldehyde and mono- or dinuclear aromatic hydroxy compounds free from aromatically bonded sulfonic acid groups, or the sulfomethylated condensation products thereof or mixtures of said aromatic hydroxy compounds and said sulfomethylated condensation products, and b. from 75 to 25% by weight of aromatic or hydroxyaromatic sulfonic acids or their condensation products with formaldehyde or their condensation products with formaldehyde and urea, or a mixture of said compounds, at least a portion of said sulfonic acids being in the form of alkali metal salts, ammonium salts or both.

2. Tanning agents as claimed in claim 1, wherein the component (a) includes as mono- or dinuclear aromatic hydroxy compound one or more compounds selected from the group consisting of phenol, naphthol, resorcinol, pyrocatechol, dioxydiphenylpropane, dihydroxydiphenylsulfone, the sulfomethylation products of the foregoing, halophenols and xylenols, and wherein the component (b) is based on a compound selected from the group consisting of benzenesulfonic acid, naphthalenesulfonic acid, phenolsulfonic acid and the condensation products of the foregoing with formaldehyde or with formaldehyde and urea.

3. Tanning agents as claimed in claim 1, wherein the component (a) is based on sulfomethylation products and the component (b) is based on condensation products of aromatic sulfonic acids with urea and formaldehyde.

4. Tanning agents as claimed in claim 1, wherein the component (b) is a condensation product of naphthalenesulfonic acid or naphtholsulfonic with urea and formaldehyde in the form of its alkali metal or ammonium salt.

* * * * *